US005658129A

United States Patent [19]

Pearce

[11] Patent Number: 5,658,129

[45] Date of Patent: Aug. 19, 1997

[54] NOVELTY CEILING FAN

[75] Inventor: Richard A. Pearce, Memphis, Tenn.

[73] Assignee: Hunter Fan Company, Memphis, Tenn.

[21] Appl. No.: 554,917

[22] Filed: Nov. 9, 1995

[51] Int. Cl.[6] ..... F01D 25/00

[52] U.S. Cl. ..... 416/5; 416/146 R; D23/377

[58] Field of Search ..... 416/5, 146 R; 362/147, 404, 408, 124; D23/377, 379, 385, 411, 413

[56] References Cited

U.S. PATENT DOCUMENTS

| | | | |
|---|---|---|---|
| D. 82,944 | 12/1930 | Karageorge . | |
| D. 98,457 | 2/1936 | Haynes . | |
| D. 266,969 | 11/1982 | Pope . | |
| D. 284,304 | 6/1986 | Harber | 416/5 |
| D. 295,430 | 4/1988 | Smith . | |
| D. 297,594 | 9/1988 | Bunch . | |
| D. 298,648 | 11/1988 | Gill . | |
| D. 312,529 | 12/1990 | Routt . | |
| D. 318,725 | 7/1991 | Jaeger | D23/377 |
| D. 320,439 | 10/1991 | Harper | D23/377 |
| D. 327,572 | 7/1992 | Way . | |
| D. 341,194 | 11/1993 | Reid et al. . | |
| D. 349,954 | 8/1994 | Steiner et al. . | |
| D. 354,979 | 1/1995 | Tsuji . | |
| D. 354,984 | 1/1995 | Tsuji . | |
| D. 359,553 | 6/1995 | Hsi . | |
| D. 364,223 | 11/1995 | DiPasquale | D23/379 |
| 2,427,952 | 9/1947 | Evans . | |
| 5,097,398 | 3/1992 | Dye | 362/808 |
| 5,151,011 | 9/1992 | Rezek . | |
| 5,222,864 | 6/1993 | Pearce | 416/5 |

FOREIGN PATENT DOCUMENTS

| | | | |
|---|---|---|---|
| 01101292 | 6/1983 | Japan | 416/5 |

*Primary Examiner*—Edward K. Look
*Assistant Examiner*—Mark Sgantzos
*Attorney, Agent, or Firm*—Baker, Donelson, Bearman & Caldwell

[57] ABSTRACT

A novelty ceiling fan is provided having an electric fan motor with separate stationary members and rotating surfaces, and a plurality of radially extending blades being secured to the one of the rotating surfaces. The ceiling fan also includes a tubular downrod for pivotally suspending the ceiling fan from a ceiling, and at least one electrical switch for selectively controlling the operation of the fan motor. A U-shaped mounting bracket is provided, securable to one of the stationary members of the fan motor, for detachably connecting a decorative globe to the fan motor substantially enclosing at least the lower and side surfaces. The decorative globe has upper and lower portions with the upper portion being comprised of a generally cylindrical side wall which defines an upper opening. The lower portion is selectively configured to generally depict conventional features of a novelty or cartoon character such as a bear head, the conventional features including a head, eyes, ears, a nose, a mouth and cheeks. Preselected portions of the conventional features are three dimensionally formed by the lower portion of the decorative globe. The plurality of blades have first and second sides wherein an appendage corresponding to the novelty character is provided on the first side and at least two bees are provided on the second side.

29 Claims, 8 Drawing Sheets

NOVELTY CEILING FAN

BACKGROUND

Electric ceiling fans are commonly utilized to assist heating and air conditioning systems by providing an additional degree of air circulation within the confines of a room. Light fixtures may also be included on the ceiling fan to provide light to a room. Thus, ceiling fans have enjoyed widespread acceptance in both residential and commercial settings.

Because ceiling fans are so centrally visible when installed, they become part of the interior decoration of a room. Usually, the style of a ceiling fan is chosen to match the room's interior decoration. However, if the interior decoration changes, the user must either accept the inconsistency between the existing fan and new decoration, or must buy a totally new fan. Since most existing ceiling fans are not designed to accommodate a wide range of interchangeable parts, the user will most often have to buy a new fan. This problem is compounded by the fact that interior decorations are sometimes only changed temporarily. Such temporary changes typically occur for parties or special events such as a holiday or birthday and usually involve providing the ceiling fan with extra decorations consistent with the event. Such external fan decorations can be dangerous if they become entangled in the fan, especially if the decorations include a string of lights or something that can potentially injure people in close proximity to the fan. Therefore, there is a need for a ceiling fan that includes interchangeable novelty parts so that the fan may change appearance for parties or special events, yet may be returned to its original configuration.

Moreover, often the elemental parts needed to make a ceiling fan operational are not aesthetically pleasing or consistent with the interior decoration of a child's room since such interior decoration normally encompasses the child's interests. These interests may include novelty or cartoon characters which are familiar to the child. Thus, there is a need for a novelty ceiling fan that depicts novelty or cartoon characters which are appealing to children, while at the same time having interchangeable parts for accommodating the child's changing interests.

SUMMARY

The present invention addresses the above needs by providing a novelty ceiling fan that includes interchangeable novelty parts which depict novelty or cartoon characters so that the fan may change appearance for parties, special events or children's rooms, yet may be returned to its original configuration.

The novelty ceiling fan utilizes a conventional electric fan motor having upper, lower and side surfaces which are selectively rotated upon operation of the motor. The motor also includes upper and lower centralized stationary members extending normally away from the upper and lower surfaces, respectively. The upper stationary member is secured to an attachment means for operatively attaching the motor to a ceiling. A mounting bracket is removably secured to the lower stationary member which includes first and second radially extending flange portions interconnected by a generally U-shaped portion. The U-shaped portion has a substantially flat bottom surface with a centrally located hole formed therethrough for receiving the lower stationary member. The flange portions each have upwardly extending generally arcuate outer lips for detachably engaging a decorative globe which substantially encloses at least the lower and side surfaces of the motor when attached to the mounting bracket. The decorative globe is sufficiently inexpensive and easily replaceable, thereby making feasible the use of multiple interchangeable globes having a variety of external novelty configurations.

The decorative globe is substantially hollow and includes upper and lower portions. The upper portion is comprised of a generally cylindrical side wall which defines an upper opening for receiving the mounting bracket therein. As referred to above, the side wall is detachably connected to the generally arcuate outer lips of the flange portions. The lower portion is integrally attached to the upper portion and is selectively configured to generally depict conventional features of a face or head of a novelty or cartoon character, such as a bear. The conventional features depicted include but are not limited to a head, eyes, ears, a nose, a mouth and cheeks. Moreover, the lower portion of the decorative globe three dimensionally defines all or preselected portions of the conventional features of the novelty character face or head.

A plurality of fan blades having first and second sides are rotatably attached to the upper surface of the fan motor. Each blade includes an appendage corresponding to the novelty character on at least one of the first and second sides. In a preferred embodiment, wherein the novelty character is a bear, the first side of the fan blades includes an arm or leg portion of the bear and the second side includes at least two bumble bees. The appendages or bees may be painted, adhesively bonded, or rigidly secured to the blades.

In order to selectively control the operation of the fan motor, the novelty ceiling fan includes a switch means. The switch means comprises a switch housing attached to the flat bottom surface of the U-shaped portion of the mounting bracket and contains a fan switch and a reversing switch both electrically connected to the motor for selectively controlling the speed and direction, respectively. When attached to the mounting bracket, the decorative globe substantially encloses the switch housing. The ceiling fan may also include an ambient light means and a night light means. The ambient light means, which has a first light intensity, is comprised of two light bulbs operatively attached to the first and second flange portions of the mounting bracket, respectively. The night light means, which is comprised of a single light bulb, is operatively attached to a bottom surface of the switch housing for illuminating the face of the novelty character. The night light means has a second light intensity less than the first light intensity of the ambient light means. If the light means are provided on the ceiling fan, the switch housing will further contain a three-way light switch electrically connected to both the ambient light means and the night light means for selective control thereof.

There has thus been outlined, rather broadly, the more important features of the present invention in order that the detailed description thereof that follows may be better understood, and that the present contribution to the art may be better appreciated. There are, of course, numerous other novel features of the present invention that will become apparent from a study of the drawings and the description and which will form the subject matter of the claims appended hereto.

Moreover, it is to be understood that the phraseology and terminology employed herein are for the purpose of description and should not be regarded as limiting. As such, those skilled in the art will appreciate that the conception, upon which this disclosure is based, may readily be utilized as a basis for the designing of other systems for carrying out the several purposes of the present invention. It is important, therefore, that the claims be regarded as including such equivalent systems insofar as they do not depart from the spirit and scope of the present invention.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
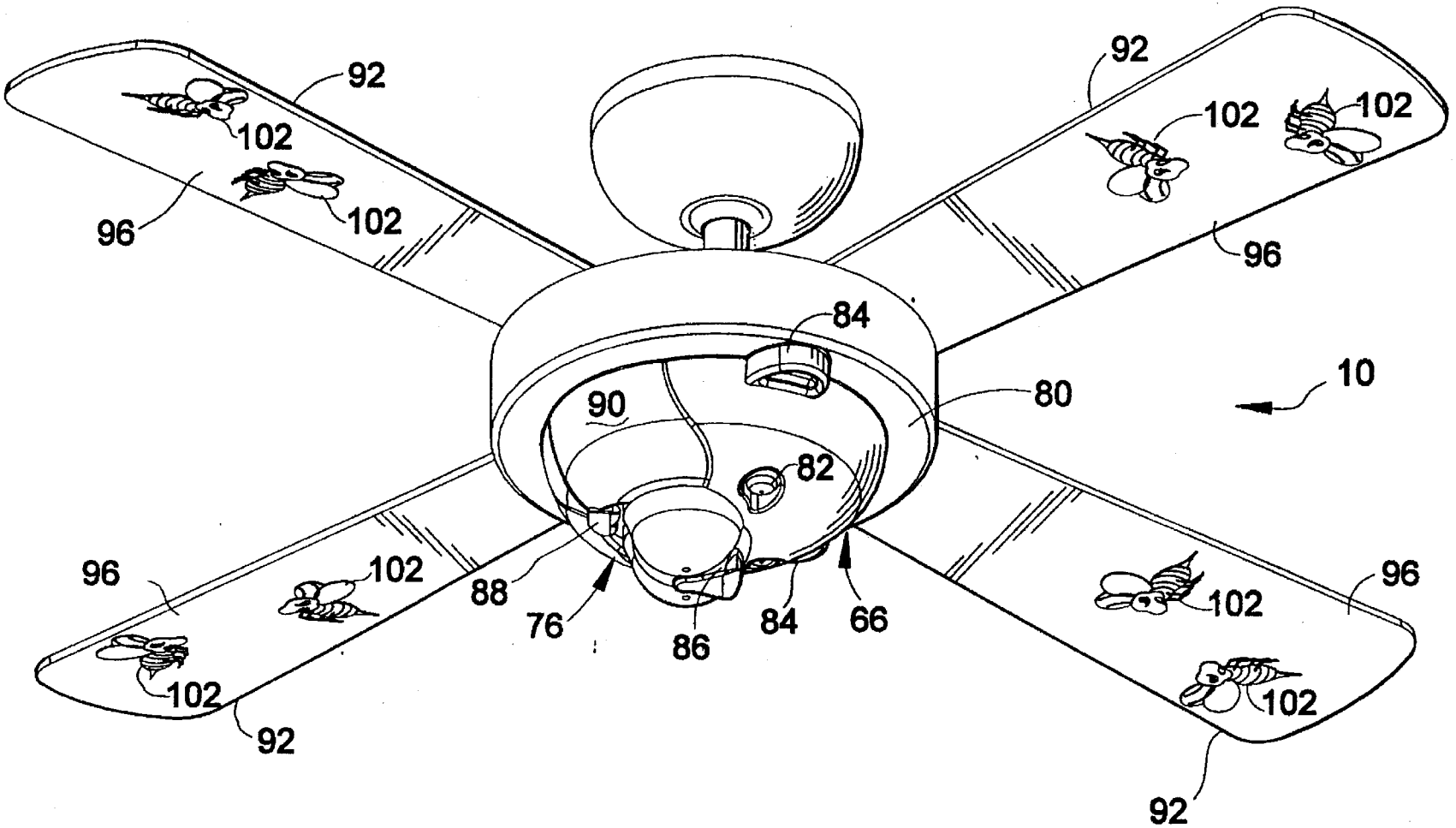
FIG. 1 is a perspective view of a representative novelty ceiling fan having a decorative globe and a plurality of fan blades embodying the features of the present invention.
Figure 2:
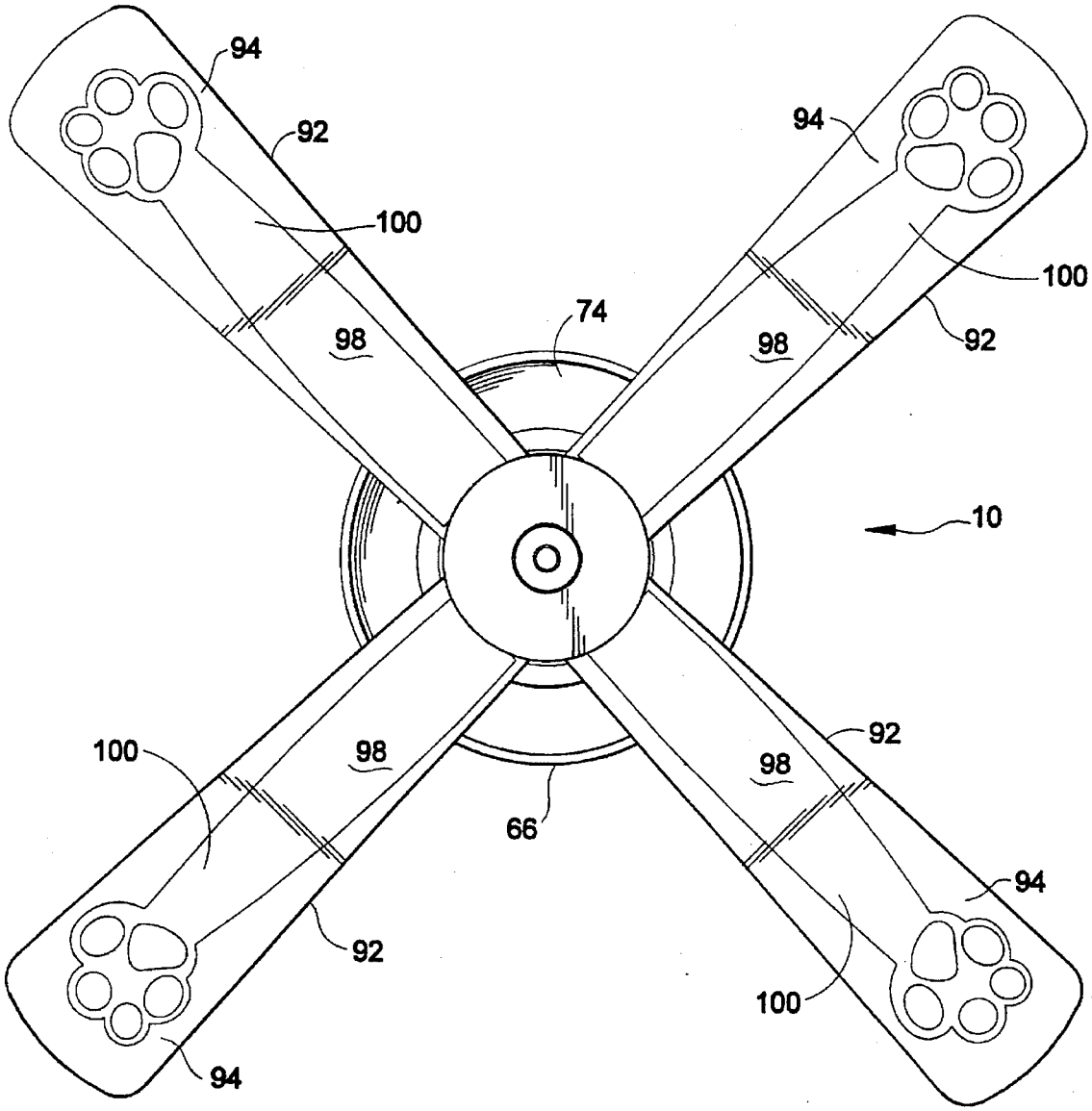
FIG. 2 is a top plan view of the representative novelty ceiling fan embodying the features of the present invention.
Figure 3:
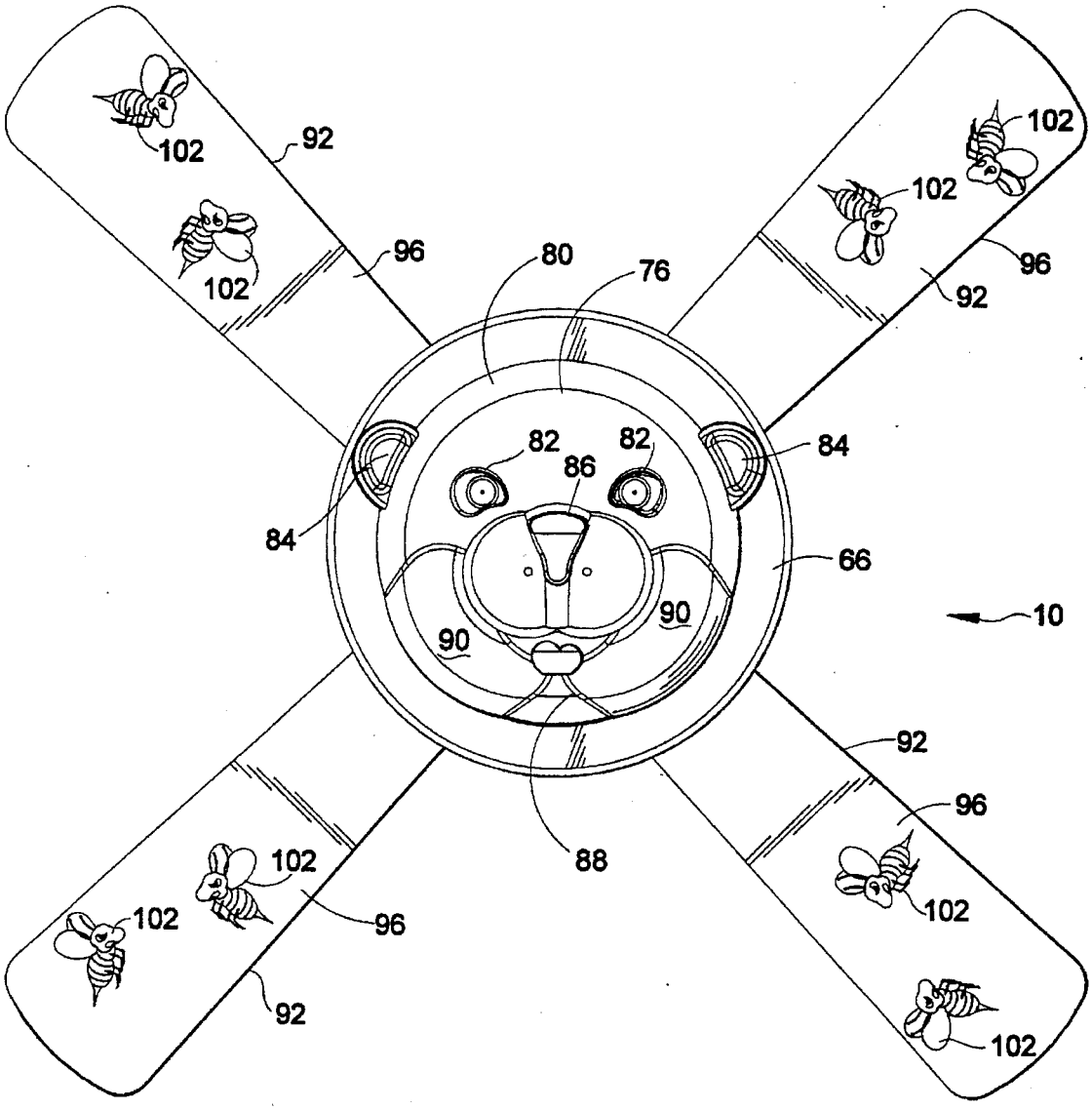
FIG. 3 is a bottom plan view of the representative novelty ceiling fan embodying the features of the present invention.

Referring now in more detail to the drawings, in which like numerals indicate like parts throughout the several view, FIGS. 1–4 disclose generally at 10 a representative novelty ceiling fan embodying the features of the present invention. A conventional purpose of the novelty ceiling fan 10 is to assist heating and air conditioning systems by providing an additional degree of air circulation within the confines of a room.

The novelty ceiling fan 10 utilizes a conventional electric fan motor 12 comprising a generally round outer side surface 14 and generally flat upper 16 and lower 18 surfaces which are selectively rotated upon operation of the motor 12. The fan motor 12 also includes a stationary externally threaded upper member 20 extending upwardly from the flat upper surface 16 and a stationary externally threaded lower member 22 extending downwardly from the flat lower surface 18. During operation of the fan motor 12, the outer side surface 14 and flat upper 16 and lower 18 surfaces rotate about the upper 20 and lower 22 threaded members.

Figure 4:
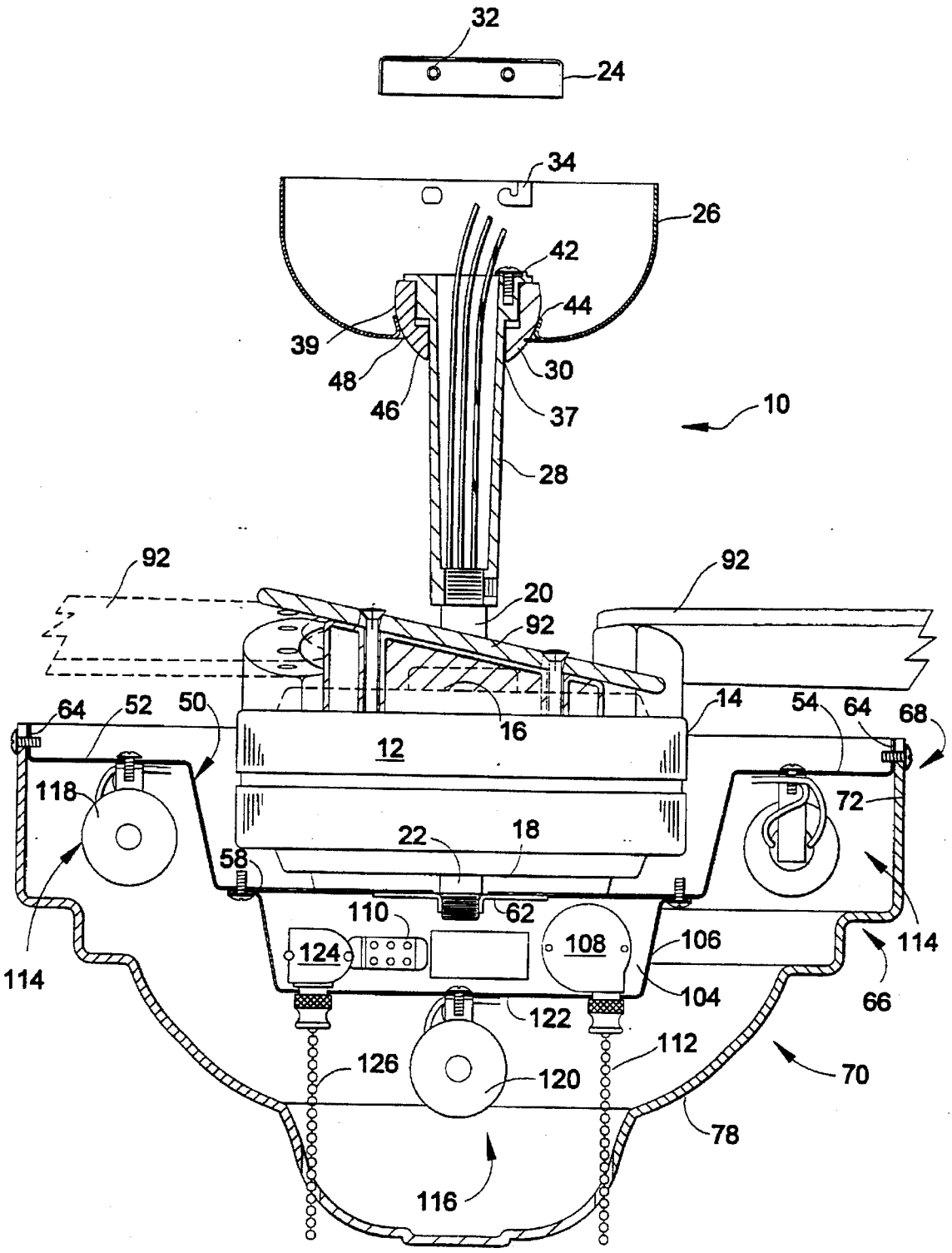
FIG. 4 is a side elevational view, partially in section, of the representative novelty ceiling fan embodying the features of the present invention.
Figure 5:
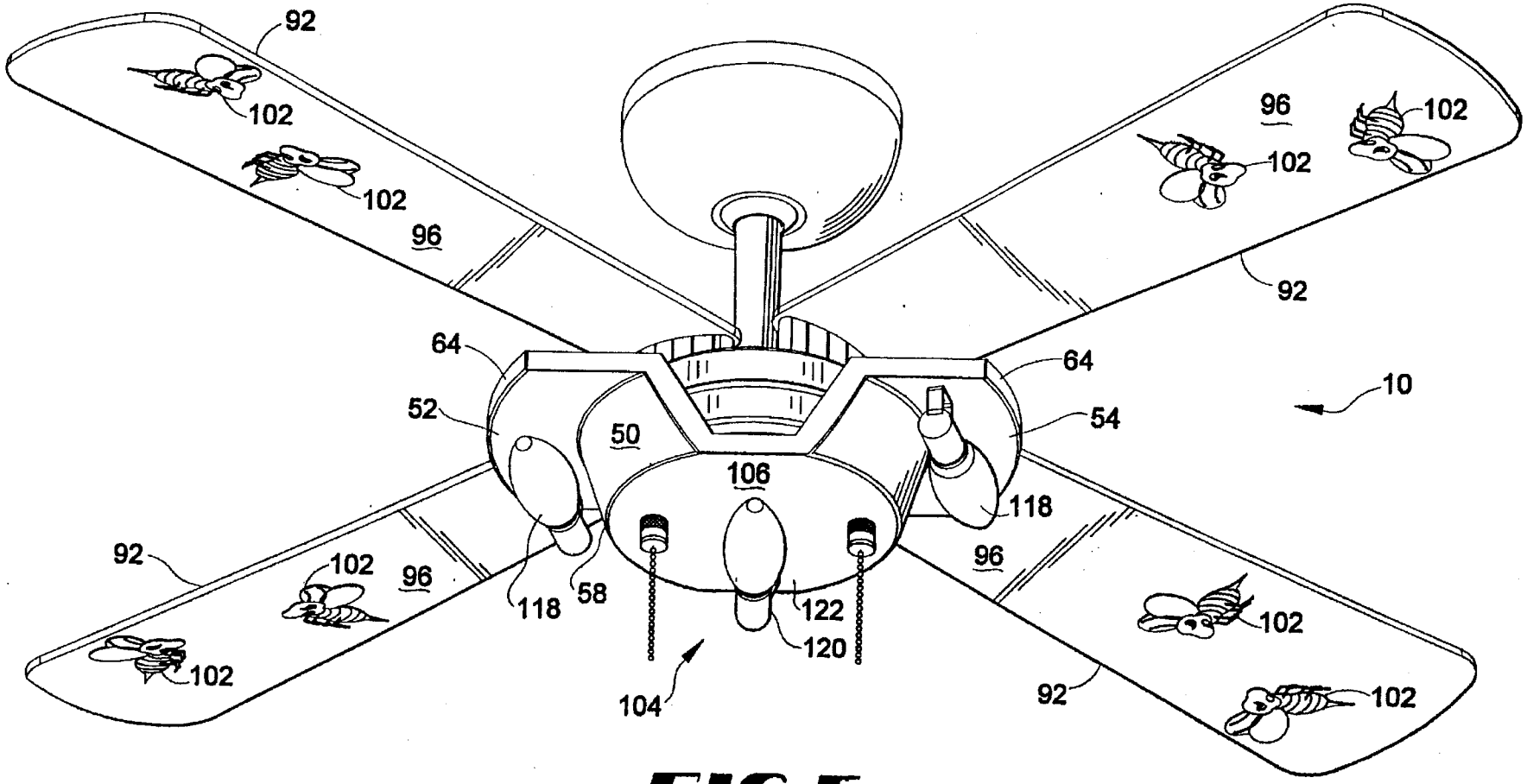
FIG. 5 is a perspective view of the representative novelty ceiling fan with the decorative globe removed embodying the features of the present invention.
Figure 6:
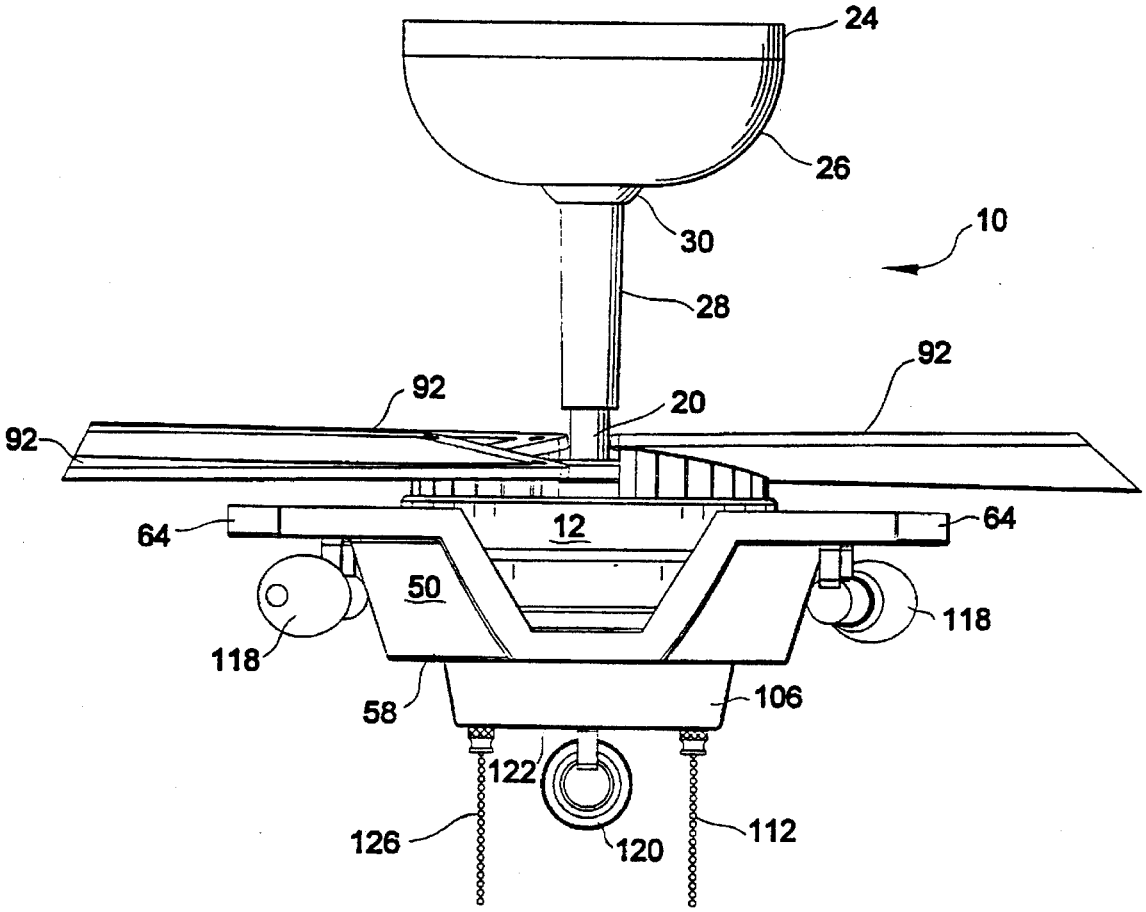
FIG. 6 is a side elevational view of the representative novelty ceiling fan with the decorative globe removed and the fan blades partially cut away embodying the features of the present invention.
Figure 7:
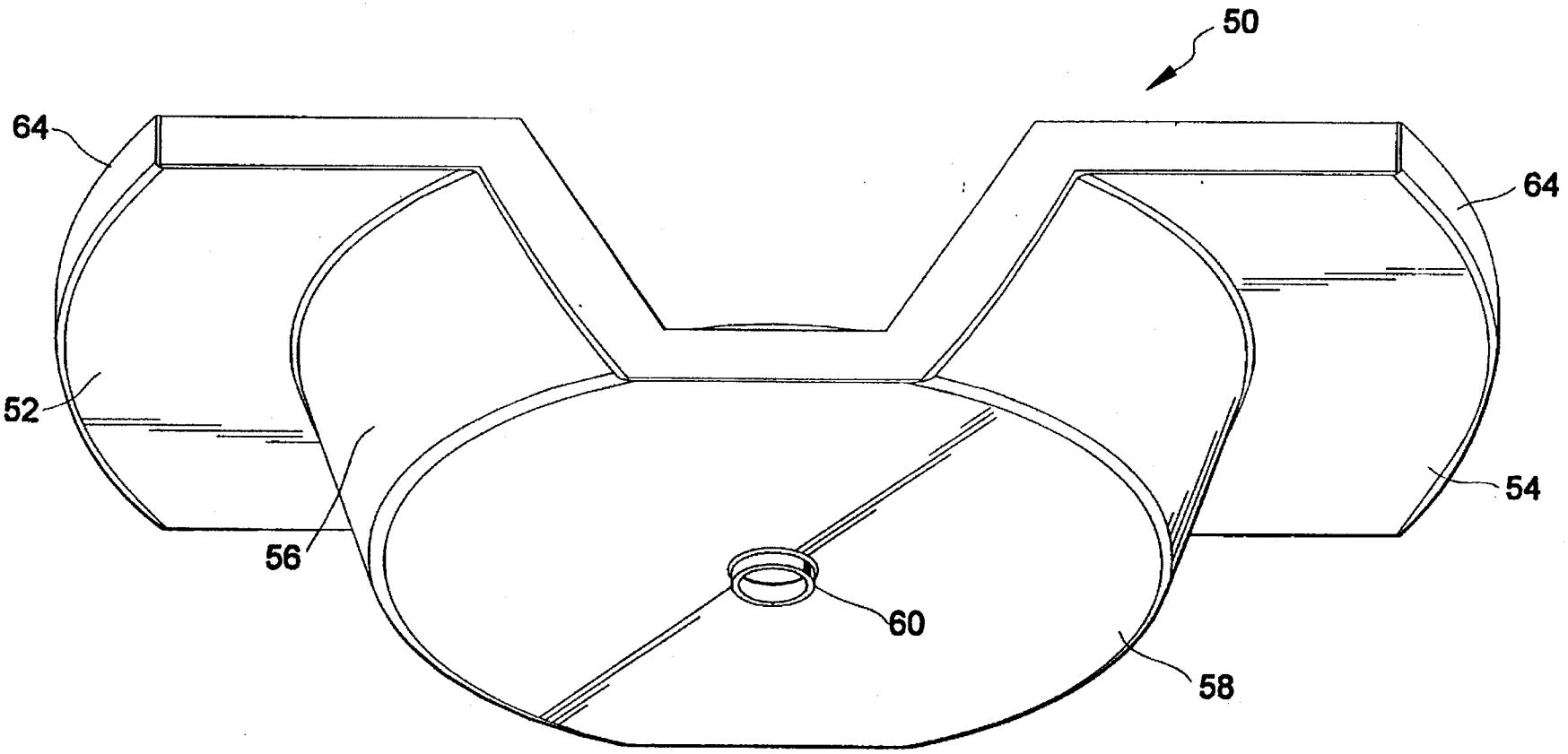
FIG. 7 is a perspective view of a mounting bracket embodying the features of the present invention.
Figure 9:
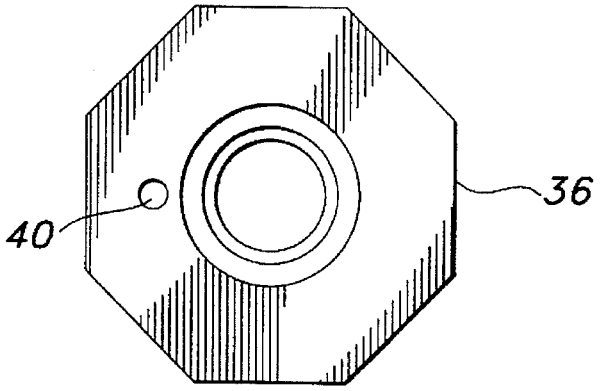
FIG. 9 is an end elevational view of the tubular down rod shown in FIG. 5.
Figure 8:
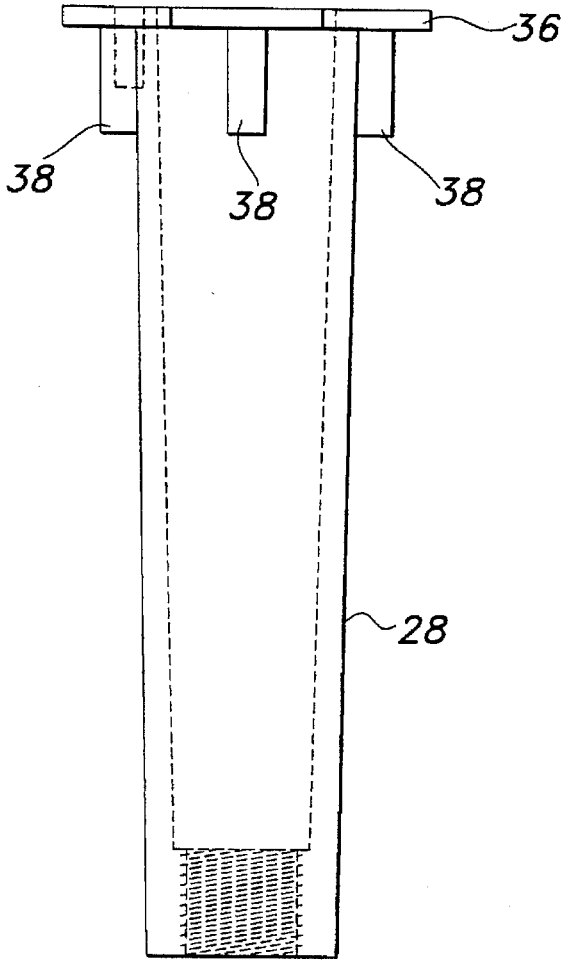
FIG. 8 is a side elevational view of a tubular down rod embodying the features of the present invention.

Referring to FIGS. 4, 8 and 9, in order to operatively attach the novelty ceiling fan 10 to a ceiling structure (not shown), the fan 10 includes a mounting plate 24, a canopy 26, a tapered tubular down rod 28 having an internally threaded lower end, and a ball member 30. The mounting plate 24 is rigidly secured to a ceiling (not shown) by conventional means (not shown). The canopy 26 is removably secured to the mounting plate 24 by suitable means. Preferably, the mounting plate 24 includes a plurality of radially extending pins 32 for operatively engaging an equal number of receptacles 34 formed in the upper perimeter of the canopy 26. By providing external threads on the stationary externally threaded upper member 20, the fan motor 12 may be secured directly to the internally threaded lower end of the tubular down rod 28 without necessitating the use of any additional fastening devices. As shown in FIGS. 8 and 9, an upper end of the tubular down rod 28 defines a flange 36 with at least one radially extending finger 38 integrally formed therewith for engaging at least one suitably formed slot defined in the ball member 30. The flange 36 serves to support the tubular down rod 28, thereby preventing the down rod 28 from passing completely through a centrally located hole in the ball member 30, while the radially extending fingers 38 substantially prevent the tubular down rod 28 from rotating relative to the ball member 30. Preferably, the flange 36 is hexagonally shaped as most clearly shown in FIG. 9, and the tubular down rod 28 includes at least four radially extending fingers 38. One of such fingers 38 includes a threaded hole 40 formed therein for engaging a screw 42 which may be employed as a ground element for the fan motor 12. It has been found that superior strength and cost effectiveness may be obtained by die casting the tubular down rod 28 and flange 36 together as a single unit. Other manufacturing techniques may also yield acceptable results. As shown in FIG. 4, the ball member 30 seats within a socket 44 formed in the canopy 26 thereby enabling the novelty ceiling fan 10 to pivot slightly relative to the canopy 26 as necessary. The ball member 30 has a groove 46 formed on its outer periphery for receiving a prong 48 formed in the canopy 26 for preventing relative rotation between the ball member 30 and canopy 26. The prong 48 preferably comprises a small extending segment of the socket 44 formed in a generally horizontal position.

A mounting bracket 50 is removably secured to the stationary lower member 22 of the fan motor 12 and includes first 52 and second 54 radially extending flange portions interconnected by a generally U-shaped portion 56. The U-shaped portion 56 has a substantially flat bottom surface 58 with a centrally located hole 60 formed therethrough for receiving the stationary lower member 22 wherein a nut 62 is threaded onto lower member 22 thereby removably securing mounting bracket 50 to motor 12. The flange portions 52, 54 each have upwardly extending generally arcuate outer lips 64 for engaging a decorative globe 66 which substantially encloses at least the lower 18 and outer side 14 surfaces of the motor 12 when attached to the mounting bracket 50.

The decorative globe 66 is substantially hollow and includes upper 68 and lower 70 integrally connected portions. The upper portion 68 is comprised of a generally cylindrical side wall 72 which defines an upper opening 74 for receiving the mounting bracket 50 therein. As referred to above, the side wall 72 is detachably connected to the generally arcuate outer lips 64 of flange portions 52, 54 by a suitable means. The lower portion 70 of the decorative globe 66 is selectively configured to depict conventional face or head features of a novelty character 78, which includes caricatures and cartoon characters. In a preferred embodiment, the novelty character 78 comprises the face of a bear. The conventional features depicted include but are not limited to a bear-like head 80, bear-like eyes 82, bear-like ears 84, a bear-like nose 86, a bear-like mouth 88 and bear-like cheeks 90. Moreover, all or preselected portions of the conventional features are three-dimensionally defined by the lower portion 70. It will be appreciated by those skilled in the art that the decorative globe 66 is sufficiently inexpensive and easily replaceable, thereby making feasible the use of multiple interchangeable globes 66 having a variety of novelty configurations.

A plurality of fan blades 92, having first 94 and second 96 reversible sides, are rotatably attached by suitable means to the upper surface 16 of the fan motor 12. The blades 92 comprise substantially planar sections of wood or other suitable material and must be maintained at an angle other than ninety degrees relative to the axis of rotation of the fan motor 12 in order to effectuate adequate air movement. Each blade 92 includes an appendage 98 corresponding to the novelty character 78 provided on at least one of the first 94 and second 96 sides. In a preferred embodiment, wherein the novelty character 78 is the face of a bear, the appendage 98 comprises an arm or leg portion 100 of the bear on the first side 94 of the blades 92. The second side 96 may include other novelty representations including winged insects such as at least one bumble bee 102. It should be noted that the appendages 98 or bees 102 may be painted, adhesively bonded, or rigidly secured to the blades 92.

In order to selectively control the operation of the fan motor 12, the novelty ceiling fan 10 includes a switch means 104. The switch means 104 comprises a switch housing 106 suitably attached to the flat bottom surface 58 of the U-shaped portion 56 of the mounting bracket 50 and contains a fan switch 108 and a reversing switch 110 both electrically connected to the motor 12 for selectively controlling the speed and direction, respectively. The fan switch 108 is selectively operable by pulling chain 112 and the reversing switch 110 is selectively operable by a button (not shown) extending through the switch housing 106. It should be understood that upon reading this disclosure that the advantages of the present invention may be realized regardless of the number or configuration of switching mechanisms employed, and that conventional switches 108 and 110 are displayed primarily by way of example and should not constitute a limitation on the scope of this invention. When attached to the mounting bracket 50, the decorative globe 66 substantially encloses the switch housing 106.

The novelty ceiling fan 10 may also include an ambient light means 114 and a night light means 116. The ambient light means 114, which has a first light intensity, is comprised of two light bulbs 118 operatively attached to the first 52 and second 54 flange portions of the mounting bracket 50, respectively. The night light means 116, which is comprised of a single light bulb 120, is operatively attached to a bottom surface 122 of the switch housing 106 for illuminating the face of the novelty character 78. The night light means 116 has a second light intensity less than the first light intensity of the ambient light means 114. In order to selectively control the light means 114, 116, the switch housing 106 will further contain a three-way light switch 124 electrically connected to both the ambient light means 114 and the night light means 116 and is selectively operable by pulling chain 126.

The above described elements of the novelty ceiling fan 10 may be provided in a kit of interchangeable parts for converting one novelty fan into another novelty fan having a different novelty character 78. The interchangeable parts include a fan motor 12, a decorative globe 66, a plurality of blades 92 and standard fasteners. Those skilled in the art will fully appreciate the fact that the decorative globe 66 may be formed from a number of suitable plastic materials which include a wide variety of colors.

While a description of the present invention has been provided in detail, such description is for illustrative purposes only, and it is to be understood that changes and variations may be made without departing from the spirit or scope of the following appended claims.

What is claimed is:

1. A novelty ceiling fan, comprising:

(a) a fan motor;

(b) attachment means, connected to said fan motor, for operatively attaching said fan motor to a ceiling;

(c) switch means, operatively connected to said fan motor, for selectively controlling operation of said fan motor;

(d) a decorative globe, having upper and lower portions, detachably connected to said fan motor, said upper portion having a generally cylindrical side wall which defines an upper opening, said lower portion depicting a face of a novelty character; and (e) a plurality of blades, with first and second sides, rotatably attached to said fan motor, said blades including an appendage corresponding to said face of said novelty character on at least one of said first and second sides.

2. A novelty ceiling fan as defined in claim 1, wherein preselected portions of said face of said novelty character are three dimensionally defined by said lower portion of said decorative globe.

3. A novelty ceiling fan as defined in claim 2, wherein said face of said novelty character comprises a face of a cartoon character.

4. A novelty ceiling fan as defined in claim 2, wherein said face of said novelty character comprises a face of a bear.

5. A novelty ceiling fan as defined in claim 4, wherein said appendage comprises an arm portion of said bear.

6. A novelty ceiling fan as defined in claim 4, wherein said appendage comprises a leg portion of said bear.

7. A novelty ceiling fan as defined in claim 1, wherein said fan motor includes upper, lower and side surfaces, said surfaces being selectively rotated upon said operation of said fan motor, said fan motor further including a stationary member extending downwardly from said lower surface.

8. A novelty ceiling fan as defined in claim 7, further comprising a mounting bracket removably secured to said stationary member, said mounting bracket having first and second radially extending flange portions interconnected by a generally U-shaped portion, said U-shaped portion having a substantially flat bottom surface with a centrally located hole formed therethrough for receiving said stationary member, said first and second flange portions each having an upwardly extending generally arcuate outer lip for engaging said decorative globe, said side wall of said decorative globe detachably engaging said outer lips so as to substantially enclose at least said lower and side surfaces of said fan motor.

9. A novelty ceiling fan as defined in claim 8, wherein said switch means comprises a switch housing attached to said flat bottom surface of said U-shaped portion, said switch housing containing a fan switch and a reversing switch both electrically connected to said fan motor for selectively controlling the speed and direction of rotation of said fan motor, respectively, said switch housing substantially enclosed by said decorative globe.

10. A novelty ceiling fan as defined in claim 1, further comprising ambient light means having a first light intensity, operatively attached to said first and second flange portions, for emitting light therefrom, said ambient light means substantially enclosed by said decorative globe.

11. A novelty ceiling fan as defined in claim 10, further comprising night light means, operatively attached to a bottom surface of said switch housing, for illuminating said face of said novelty character, said night light means having a second light intensity less than said first light intensity of said ambient light means, said night light means substantially enclosed by said decorative globe.

12. A novelty ceiling fan as defined in claim 11, wherein said switch housing further contains a light switch electrically connected to both said ambient light means and said night light means for selectively controlling said ambient light means and said night light means.

13. A novelty ceiling fan, comprising:

(a) a fan motor;

(b) attachment means, connected to said fan motor, for operatively attaching said fan motor to a ceiling;

(c) switch means, operatively connected to said fan motor, for selectively controlling operation of said fan motor;

(d) a decorative globe, having upper and lower portions, detachably connected to said fan motor, said upper portion having a generally cylindrical side wall which defines an upper opening, said lower portion selectively configured to depict conventional features of a bear head, said conventional features including a head, eyes, ears, a nose, a mouth and cheeks; and (e) a plurality of blades, with first and second sides, rotatably attached to said fan motor, said blades including an appendage corresponding to said bear head on said first side and at least one bee on said second side.

14. A novelty ceiling fan as defined in claim 13, wherein said lower portion of said decorative globe three dimensionally defines preselected portions of said conventional features of said bear head.

15. A novelty ceiling fan as defined in claim 14, wherein said appendage comprises an arm portion of said bear head.

16. A novelty ceiling fan as defined in claim 14, wherein said appendage comprises a leg portion of said bear head.

17. A novelty ceiling fan as defined in claim 13, wherein said fan motor includes upper, lower and side surfaces, said surfaces being selectively rotated upon said operation of said fan motor, said fan motor further including a stationary member extending downwardly from said lower surface.

18. A novelty ceiling fan as defined in claim 17, further comprising a mounting bracket removably secured to said stationary member, said mounting bracket having first and second radially extending flange portions interconnected by a generally U-shaped portion, said U-shaped portion having a substantially flat bottom surface with a centrally located hole formed therethrough for receiving said stationary member, said first and second flange portions each having upwardly extending generally arcuate outer lips for engaging said decorative globe, said side wall of said decorative globe detachably engaging said outer lips so as to substantially enclose at least said lower and side surfaces of said fan motor.

19. A novelty ceiling fan as defined in claim 18, wherein said switch means comprises a switch housing attached to said flat bottom surface of said U-shaped portion, said switch housing containing a fan switch and a reversing switch both electrically connected to said fan motor for selectively controlling the speed and direction of rotation of said fan motor, respectively, said switch housing substantially enclosed by said decorative globe.

20. A novelty ceiling fan as defined in claim 19, further comprising ambient light means having a first light intensity, operatively attached to said first and second flange portions, for emitting light therefrom, said ambient light means substantially enclosed by said decorative globe.

21. A novelty ceiling fan as defined in claim 20, further comprising night light means, operatively attached to a bottom surface of said switch housing, for illuminating said face of said novelty character, said night light means having a second light intensity less than said first light intensity of said ambient light means, said night light means substantially enclosed by said decorative globe.

22. A novelty ceiling fan as defined in claim 21, wherein said switch housing further contains a light switch electrically connected to both said ambient light means and said night light means for selectively controlling said ambient light means and said night light means.

23. A kit of interchangeable parts for converting one novelty ceiling fan into another novelty ceiling fan, comprising:

(a) a decorative globe having a preselected face of a novelty character three dimensionally formed thereon; and (b) a plurality of fan blades each having an appendage corresponding to said face of said novelty character provided thereon.

24. A kit as defined in claim 23, further comprising a plurality of standard fasteners for attaching said decorative globe to said one novelty ceiling fan.

25. A kit of interchangeable parts for converting one novelty ceiling fan into another novelty ceiling fan, comprising:

(a) a decorative globe having a face of a bear three dimensionally formed thereon;

(b) a plurality of standard fasteners for attaching said decorative globe to said one novelty ceiling fan; and (c) a plurality of fan blades each having an appendage corresponding to said face of said bear provided thereon.

26. A novelty ceiling fan kit, comprising:

(a) a fan motor;

(b) a decorative globe having a head of a novelty character with a head, ears, eyes, a nose, a mouth and cheeks three dimensionally formed thereon;

(c) a plurality of standard fasteners for attaching said decorative globe to said fan motor; and (d) a plurality of blades having an appendage corresponding to said head of said novelty character provided thereon.

27. A novelty ceiling fan, comprising:

a fan motor;

at least one switch for selectively controlling operation of said fan motor;

a decorative globe detachably connected to said fan motor, said globe depicting a face of a novelty character; and a plurality of blades rotatably attached to said fan motor, at least one of the blades depicting an appendage corresponding to said face of the novelty character.

28. A novelty ceiling fan as defined in claim 27, wherein preselected portions of the face of said novelty character are three-dimensionally defined by a lower portion of said decorative globe.

29. A kit of interchangeable parts for converting one ceiling fan into another ceiling fan, comprising:

a decorative globe depicting at least a portion of a three-dimensional head of a novelty character; and a plurality of fan blades each depicting an appendage corresponding to the head of said novelty character.

* * * * *